United States Patent [19]

Farb

[11] 4,224,932

[45] Sep. 30, 1980

[54] VIBRATORY MASSAGE UNIT

[76] Inventor: Norman E. Farb, 10705 Providence Rd., Villa Park, Calif. 92667

[21] Appl. No.: 28,577

[22] Filed: Apr. 9, 1979

[51] Int. Cl.[3] ..... A61H 1/00

[52] U.S. Cl. ..... 128/36

[58] Field of Search ..... 128/32, 34–37, 128/46, 47, 33, 44, 48, 49, 56

[56] References Cited

U.S. PATENT DOCUMENTS

| | | | |
|---|---|---|---|
| 1,301,866 | 4/1919 | Moore | 128/35 |
| 2,174,452 | 9/1939 | Torrison | 128/36 |
| 2,523,547 | 9/1950 | Zerkle | 128/36 |
| 3,314,417 | 4/1967 | Starre et al. | 128/36 |
| 3,322,117 | 5/1967 | McCaw | 128/33 |
| 3,363,623 | 1/1968 | Atwell | 128/36 |
| 3,494,353 | 2/1970 | Marich | 128/36 |

*Primary Examiner*—Lawrence W. Trapp

*Attorney, Agent, or Firm*—Philip M. Hinderstein

[57] ABSTRACT

A handle for a vibratory massage unit of the type including an applicator head which translates laterally in a circular motion upon rotation of a drive shaft. The handle solves the problem of excessive vibration by providing static and dynamic balancing of the moving parts so as to prevent operator fatigue. A pair of offset bearings provide the transition from pure rotational motion to translational motion and an oppositely offset counterweight provides the static and dynamic balancing.

23 Claims, 5 Drawing Figures

VIBRATORY MASSAGE UNIT

BACKGROUND OF THE INVENTION

1. Field of the Invention

The present invention relates to a vibratory message unit and, more particularly, to a dynamically balanced applicator handle for a vibratory massage unit which eliminates vibration and operator fatigue.

2. Description of the Prior Art

In the fields of physical therapy and physical fitness, it is known to provide a vibratory massage unit for applying a vibratory force to different parts of the body. In physical therapy, such units are used for respiratory, as well as other types of muscular therapy. Such units are helpful for the massage and development of the muscle skeletal system, the skin, the nervous system, and the lungs.

A conventional vibratory massage unit includes a motor, typically mounted within a housing, which drives a flexible drive cable positioned within a coaxial cable sheath. The housing may include a timer and a vibration rate control. A meter for indicating vibratory cycles may also be included. The end of the drive cable is connected to an applicator handle which includes an applicator head, the part adapted to contact the body of a patient. The applicator handle converts the rotary motion of the cable to a lateral translation, with the applicator head moving in a generally circular pattern. Either the side or the front of the applicator head may be placed against the patient's body.

A significant problem that has existed in prior units of this type has been excessive vibration of the applicator handle. More specifically, units designed heretofore have worked effectively when the applicator head is placed against the body of a patient because the patient's body absorbs whatever vibration exists in the applicator handle. However, when the therapist removes the handle from the patient's body to move it to another location, the vibration absorbing function of the body ceases and the handle itself vibrates. In virtually all units, this vibration has been excessive, resulting in operator fatigue. Considering that many physical therapists and others use such a unit for extended periods of time, this has been a serious problem.

SUMMARY OF THE INVENTION

According to the present invention, there is provided an applicator handle for a vibratory massage unit which solves these problems in a manner unknown heretofore. The present applicator handle solves the problem of excessive vibration by statically and dynamically balancing all moving parts within the handle. Accordingly, when an operator removes the applicator handle from a patient's body, with the drive motor still activated, the applicator head rotates quietly and smoothly, without vibration. Furthermore, the design of the present applicator handle is simple and efficient, with each part providing as many functions as possible. A single offset member provides the transition from pure rotational motion to translational motion as well as providing static and dynamic balancing. The grip can rotate relative to the cable sheath so that the operator does not have to regrip the unit as the vibrational energy is provided to various parts of the body.

Briefly, and in accordance with the present invention, a handle for a vibratory massage unit connectable to a drive cable within a coaxial cable sheath comprises an elongate handle sleeve connectable to the cable sheath, a drive shaft connectable to the drive cable, first bearing means for supporting the drive shaft coaxially within the handle sleeve for rotation relative thereto, housing means surrounding the drive shaft, second bearing means operatively connected to the housing means, means for connecting the second bearing means to the drive shaft for permitting rotation of the drive shaft relative to the housing means, the connecting means supporting the second bearing means with the axis thereof offset on one side of the drive shaft whereby the housing means translates laterally in a circular pattern upon rotation of the drive shaft, an applicator head connectable to the housing means, and a counterweight operatively connected to the drive shaft with the axis of the counterweight offset on an opposite side of the drive shaft from the one side thereof for balancing the weight of the housing means, the second bearing means, and the applicator head.

OBJECTS, FEATURES, AND ADVANTAGES

It is therefore an object of the present invention to solve the problem of excessive vibration of the applicator handle in a vibratory massage unit. It is a feature of the present invention to solve this problem by providing a statically and dynamically balanced applicator handle for a vibratory massage unit. An advantage to be derived is that excessive vibration of the handle is eliminated. A further advantage is that operator fatigue is minimized.

It is a further object of the present invention to solve the problems associated with multiple, complex part, applicator handles for vibratory massage units. It is a feature of the present invention to solve these problems by providing a simple and rugged structure in which each part provides as many functions as possible. An advantage to be derived is a simplified construction in which the goals of static and dynamic balancing are achieved with a minimum number of parts. A further advantage is that manufacturing costs are minimized. A still further advantage is that manufacturing procedures are simplified.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figures 1, 5:
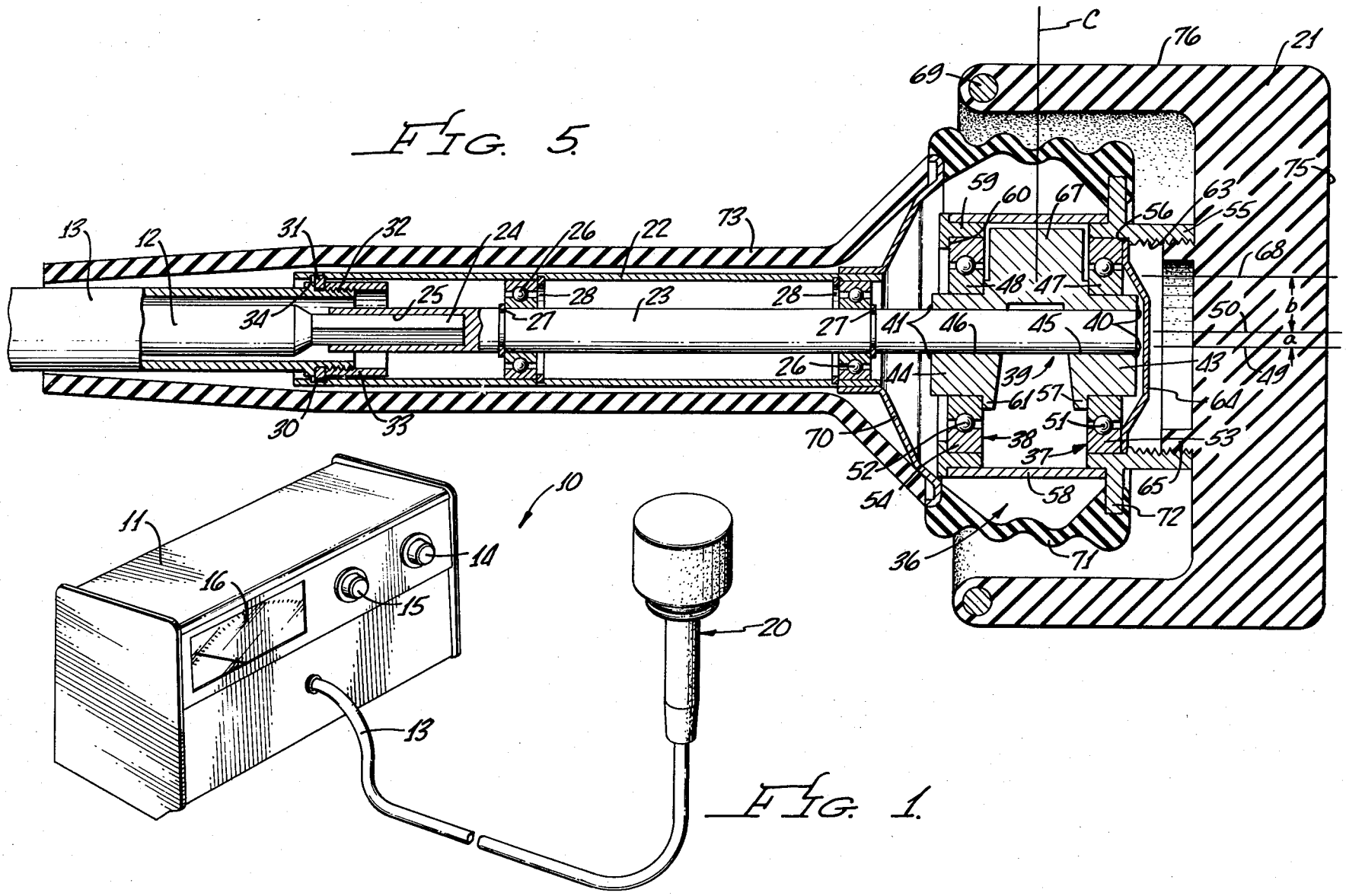
FIG. 1 is a perspective view of a vibratory massage unit including an applicator handle constructed in accordance with the teachings of the present invention.
FIG. 5 is a longitudinal sectional view of the applicator handle of FIG. 1.
Figures 2, 3, 4:
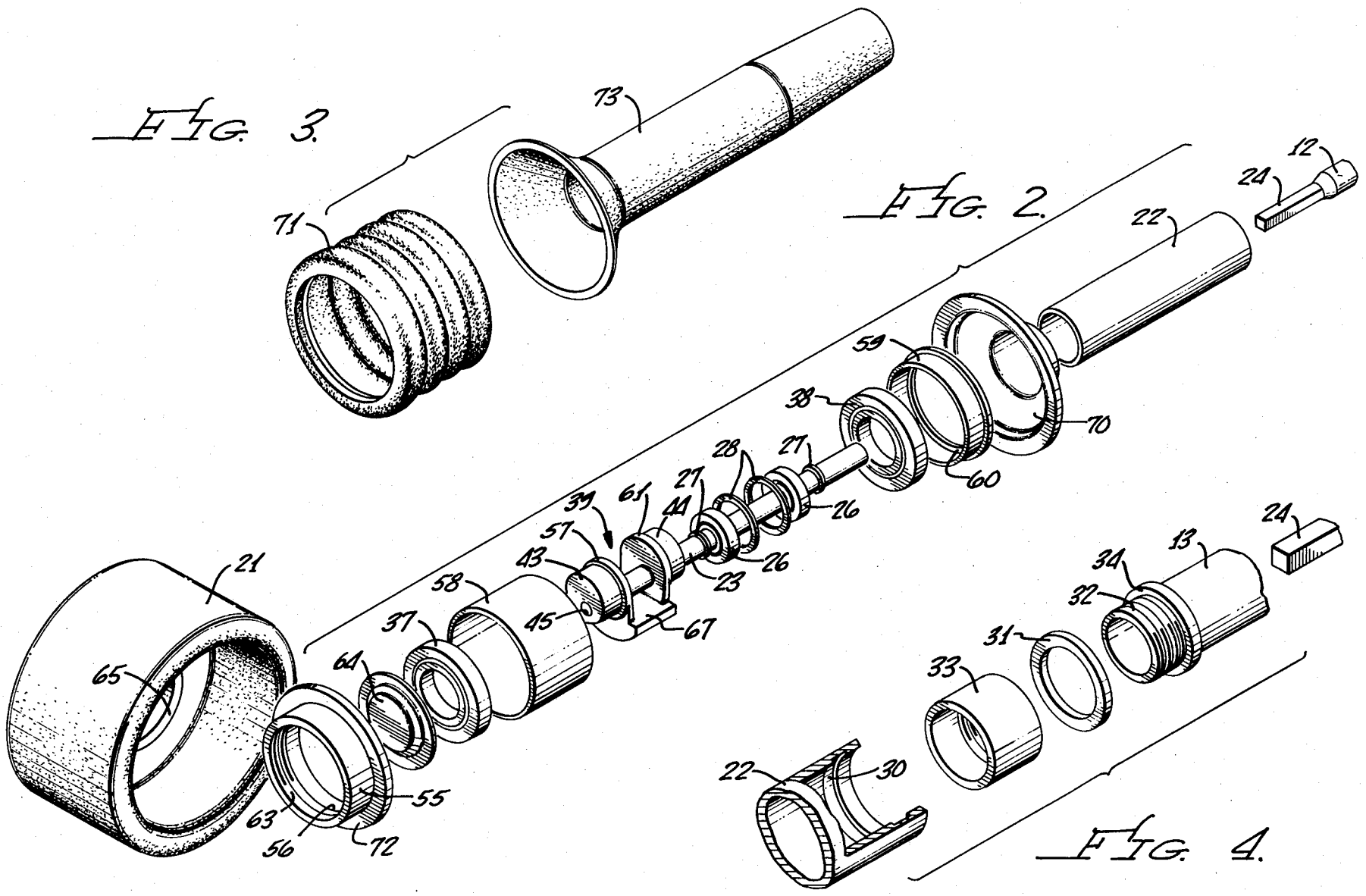
FIGS. 2, 3, and 4 are exploded perspective views of portions of the applicator handle of FIG. 1.

Referring now to the drawings, and more particularly, to FIG. 1 thereof, there is shown a vibratory massage unit, generally designated 10, including an applicator handle, generally designated 20, constructed in accordance with the teachings of the present invention. Unit 10 includes a housing 11, in which is mounted a drive motor (not shown), the output of which is connected to a flexible drive cable 12 (shown in FIGS. 2 and 4) which extends through a flexible cable sheath 13. Housing 11 may include a first knob 14 for controlling a timer (not shown) and a second knob 15 for controlling the motor drive circuitry (not shown) for controlling the vibration rate. A meter 16 may also be included for indicating the actual vibratory cycles.

Referring now to FIGS. 2, 3, 4, and 5, applicator handle 20 is connectable to the free end of drive cable 12 and includes an applicator head 21 which translates laterally in a circular motion upon rotation of drive cable 12. More specifically, applicator handle 20 includes an elongate sleeve 22 and an elongate drive shaft 23 mounted coaxially within sleeve 22. The free end of drive cable 12 may be formed with a square or equivalently-shaped cross-section, as shown at 24, for insertion into a similarly shaped bore 25 in one end of drive shaft 23 for interconnecting cable 12 and drive shaft 23 for rotation of shaft 23 by cable 12. Shaft 23 is supported within sleeve 22 for rotation relative thereto by a pair of bearings 26, the inner races of which are connected to shaft 23 and the outer races of which are connected to sleeve 22. A pair of bearing retainers 27 connected to shaft 23 and a pair of bearing retainers 28 connected to sleeve 22 prevent longitudinal motion of shaft 23 or bearings 26 relative to sleeve 22.

One end of sleeve 22, adjacent the one end of drive shaft 23, has a lateral groove 30 in the inside surface thereof for receipt of a retaining ring 31. Ring 31 is connected to the free end of sheath 13 for rotation therewith relative to groove 30. More specifically, the end of cable sheath 13 extends through ring 31 and is externally threaded, as shown at 32. These threads engage the internal threads of a slip nut 33 positioned between cable 12 and sleeve 22. An abutment 34 on the outside surface of cable sheath 13 functions with nut 33 to sandwich ring 31 therebetween, locking ring 31 to cable sheath 13. The result is that sleeve 22 can rotate but not translate relative to sheath 13 so that the operator can rotate applicator handle 20 relative to cable 12 and sheath 13 during use thereof so that the operator does not have to regrip applicator handle 20 as the vibrational energy of head 21 is provided to various parts of a patient's body.

Applicator handle 20 also includes a multiple part housing, generally designated 36, which surrounds the other end of drive shaft 23 and which is connected thereto by bearings 37 and 38. Housing 36 and bearings 37 and 38 are offset on one side of drive shaft 23 whereby housing 36 translates laterally in a circular pattern upon rotation of drive shaft 23. This is achieved through the intermediary of a bearing support and counterweight member, generally designated 39, which is connected to the other end of drive shaft 23 such as by welding, as shown at 40 and 41. More specifically, member 39 includes first and second cylindrical sections 43 and 44 which have offset coaxial holes 45 and 46, respectively, therein. The inner races 47 and 48 of bearings 37 and 38, respectively, are mounted on the external cylindrical surfaces of sections 43 and 44, respectively. It is sections 43 and 44 of member 39 which offset bearings 37 and 38 on one side of drive shaft 23 so that the axis 49 of housing 36 and bearings 37 and 38 is offset by a distance "a" from the axis 50 of drive shaft 23.

Bearings 37 and 38 include multiple ball bearings 51 and 52, respectively, between inner races 47 and 48, respectively, and outer races 53 and 54, respectively, the latter being connected to housing 36. More specifically, housing 36 includes a first sleeve-like member 55 having a circumferential abutment 56 in the inside surface thereof which engages the outer edge of a disc-like shield 64 positioned between abutment 56 and outer race 53 of bearing 37. Abutment 56 urges inner race 47 of bearing 37 against a lip 57 made integral with section 43 of member 39. Housing 36 also includes a second sleeve-like member 58 which is connected to member 55 in any convenient manner, such as by press fitting member 55 into one end of member 58. Housing 36 also includes a third sleeve-like member 59 which is connected to the other end of member 58, such as by a press fit. Member 59 has a circumferential abutment 60 in the inside surface thereof which engages outer bearing race 54 of bearing 38 and urges inner race 48 of bearing 38 against a lip 61 made integral with section 44 of member 39.

Shield 64 covers bearing 37, member 39, and the end of drive shaft 23. Member 58 covers bearings 37 and 38 and member 39. Member 55 is internally threaded, as shown at 63. The internal threads 63 in member 55 provide means for connection of applicator head 21 to housing 36. For example, applicator head 21, which may have any desired shape, may include an externally threaded ring 65 which engages threads 63 to connect head 21 to member 55.

It can be seen from an inspection of FIG. 5 that the longitudinal axes of applicator head 21, bearings 37 and 38, sections 43 and 44 of member 39, members 55, 58, and 59, and shield 64 are all coaxial, the axis being shown as axis 49. All of these elements are concentric around axis 49 so that the center of mass of such elements also coincides with axis 49. This axis is offset by distance "a" on one side of axis 50 of drive shaft 23, the rotational axis of applicator 20. Axis 49 obviously rotates around axis 50, remaining parallel thereto.

To provide static and dynamic balancing of handle 20 around axis 50, member 39 includes a counterweight section 67 which is offset on an opposite side of axis 50 from axis 49. Section 67 is made integral with sections 43 and 44. According to the present invention, the mass and location of counterweight section 67 are such that the center of the mass of section 67 is along an axis 68 which is at a distance "b" from axis 50, on the opposite side of axis 50 from axis 49. To achieve static and dynamic balancing of handle 20, the equation $$M_c \times a = M_w \times b \qquad (1)$$

must be satisfied, where $M_c$=the combined mass of all offset elements having axis 49 as their longitudinal axis, i.e. elements 21, 37, 38, 43, 44, 55, 58, 59, and 64, and $M_w$=the mass of counterweight section 67 of member 39.

To provide balancing of handle 20 in the axial direction, the center of mass $M_c$ should coincide with the center of mass $M_w$, plane "c". This may be achieved by wrapping head 21 around housing 36 and weighting the end of head 21, on one side of plane "c", with an annular weight 69, to balance the mass of the remainder of head 21 and the other elements on the other side of plane "c".

Applicator handle 20 further includes a bell housing 70, one end of which is connected to the other end of sleeve 22 and the other end of which is connected to one end of an elongate, generally cylindrical, flexible bellows 71. The other end of bellows 71 is connected to a radially outwardly extending flange 72 made integral with member 55. It can be seen from an inspection of FIG. 5 that bell housing 70 and the end of bellows 71 connected thereto remain stationary with sleeve 22 as shaft 23 rotates and that the other end of bellows 71 translates in a circular pattern with rotation of shaft 23.

Handle 20 also includes an elongate, sleeve-like grip 73 which extends over sleeve 22, from bellows 71 to cable sheath 13. Grip 73 is preferably made from a flexible material, such as rubber, and covers bell housing 70, handle sleeve 22, and the connections between sheath 13 and sleeve 22. In this manner, grip 73 provides a continuous, smooth surface for gripping by the operator and to protect and isolate the operator from the operative parts of applicator handle 20.

Applicator head 21 may have any desired shape including a flat front surface 75 which may be used to contact the skin and which moves parallel thereto and a cylindrical side surface 76 which may be applied to the skin and which moves perpendicular thereto. Head 21 may be made from foam or other soft material in order to achieve its intended function.

The operation of applicator handle 20 should be evident from an inspection of FIG. 5. Bearings 26 support shaft 23 for rotation relative to sleeve 22 upon being driven by drive cable 12. Shaft 23 rotates member 39 therewith, causing sections 43, 44, and 67 to rotate around axis 50. Sections 43 and 44 of member 39 support the sections of housing 36 concentric with axis 49. As inner races 47 and 48 of bearings 37 and 38, respectively, rotate, outer races 53 and 54, respectively, translate in a circular pattern. This same motion is applied to members 55, 58, and 59 of housing 36 which are prevented from rotating by bellows 71. As a result, members 55, 58, and 59, and bellows 71 all translate in a circular pattern and this circular motion is transmitted to head 21.

Significantly, the center of mass of all of elements 21, 37, 38, 43, 44, 55, 58, 59, and 64 remains aligned with axis 49 during this rotation and this center of mass is on the opposite side of axis 50 from the center of mass 68 of counterweight 67. As long as equation (1) above is satisfied, the mass of counterweight section 67 of member 39 statically and dynamically balances this combined mass so that handle 20 does not vibrate when an operator holds handle 20 by gripping element 73. The operator may then put either surface 75 or surface 76 of applicator head 21 against the body of a patient for the usual purposes a vibratory massage unit is used for.

Because of the rotary connection between sheath 13 and sleeve 22, the operator can also rotate grip 73 and sleeve 22 relative to cable sheath 13 without changing the hand position on grip 73 as the vibratory energy of head 21 is provided to various parts of the patient's body.

It can also be seen that the various parts of applicator handle 20 have been designed to provide as many features as possible. For example, drive shaft 23 is provided with a square bore 25 in one end thereof to provide coupling to end 24 of flexible drive cable 12 while also providing rotational support for all other members. Member 39 and bearings 37 and 38 provide the transition from the pure rotational motion of shaft 23 to the translational motion of housing 36 as well as providing static and dynamic balancing of all rotational parts. Head 21 allows for lateral and transverse motion surfaces for application to the body and also cooperates in the static and dynamic balancing of handle 20. Ring 30 not only connects cable sheath 13 to sleeve 22, but permits rotation of these parts relative to each other.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A handle for a vibratory massage unit connectable to a drive cable within a coaxial cable sheath comprising:

an elongate handle sleeve connectable to said cable sheath;

a drive shaft connectable to said drive cable;

first bearing means for supporting said drive shaft coaxially within said handle sleeve for rotation relative thereto;

housing means surrounding said drive shaft;

second bearing means operatively connected to said housing means;

means for connecting said second bearing means to said drive shaft for permitting rotation of said drive shaft relative to said housing means, said connecting means supporting said second bearing means with the axis thereof offset on one side of said drive shaft whereby said housing means translates laterally in a circular pattern upon rotation of said drive shaft;

an applicator head connectable to said housing means; and a counterweight operatively connected to said drive shaft with the axis of said counterweight offset on an opposite side of said drive shaft from said one side thereof for balancing the weight of said housing means, said second bearing means, and said applicator head.

2. A handle according to claim 1, wherein one end of said handle sleeve is connectable to said cable sheath so as to permit rotational movement of said handle sleeve relative to said cable sheath.

3. A handle according to claim 1, further comprising:

means connecting one end of said handle sleeve to said cable sheath for permitting rotational movement of said handle sleeve relative to said cable sheath.

4. A handle according to claim 3, wherein said rotational movement permitting connecting means comprises:

a groove on the inside surface of said handle sleeve; and a ring connected to said cable sheath and positioned in said groove in said handle sleeve for permitting rotational movement of said handle sleeve but not longitudinal movement thereof relative to said cable sheath.

5. A handle according to claim 3 or 4, wherein one end of said drive cable has a non-circular cross-section and wherein one end of said drive shaft, adjacent said one end of said handle sleeve, has an axial bore therein having the same cross-section as said one end of said drive cable for receipt of same for driving said drive shaft with said drive cable.

6. A handle according to claim 1, wherein said second bearing means comprises:

at least one inner bearing race;
at least one outer bearing race; and
ball bearing means between said inner and outer races, said housing means being connected to said outer bearing race.

7. A handle according to claim 6, wherein said connecting means comprises:
a cylindrical member having an offset axial hole extending therethrough, said drive shaft extending through said hole in said member and being connected thereto, said member being positioned within said inner bearing race and being connected thereto.

8. A handle according to claim 7, wherein said counterweight is made integral with said cylindrical member and is connectable to said drive shaft together therewith.

9. A handle according to claim 1, wherein said second bearing means comprises:
first and second inner bearing races;
first and second outer bearing races; and
ball bearing means between said first inner and outer races and said second inner and outer races, said housing means being connected to said first and second outer bearing races.

10. A handle according to claim 9, wherein said connecting means comprises:
first and second cylindrical members having offset coaxial holes extending therethrough, said drive shaft extending through said holes in said first and second cylindrical members and being connected to said first and second members, said first and second members being positioned within said first and second inner bearing races, respectively, and being connected thereto.

11. A handle according to claim 10, wherein said counterweight is made integral with said first and second cylindrical members and is connectable to said drive shaft together therewith.

12. A handle according to claim 11, wherein said counterweight is positioned between said first and second cylindrical members.

13. A handle according to claim 1, further comprising:
a bell housing, one end of said bell housing being connected to said handle sleeve, the other end of said bell housing extending towards said housing means, terminating adjacent one end thereof.

14. A handle according to claim 13, further comprising:
an elongate sleeve-like bellows made from a flexible material, one end of said bellows being connected to said other end of said bell housing, the other end of said bellows being connected to the other end of said housing.

15. A vibratory applicator handle comprising:
a drive shaft;
an elongate handle sleeve;
first bearing means operatively positioned between said handle sleeve and said drive shaft for supporting said drive shaft coaxially within said handle sleeve for rotation relative thereto;
a cylindrical support member having an offset axial hole extending therethrough, said drive shaft extending through said hole in said support member and being connected thereto;
an elongate housing sleeve surrounding said support member;
second bearing means operatively connected between said cylindrical support member and said housing sleeve, said cylindrical support member supporting said second bearing means and said housing sleeve with the axes thereof coaxial and offset from said drive shaft axis;
flexible means connected between said handle sleeve and said housing sleeve for preventing rotation of said housing sleeve relative to said handle sleeve whereby said housing sleeve translates laterally in a circular pattern upon rotation of said drive shaft; and
a counterweight operatively connected to said drive shaft with the axis of said counterweight offset on an opposite side of said drive shaft axis from the axis of said second bearing means for balancing the weight of said housing sleeve, said second bearing means, and said applicator head.

16. An applicator handle according to claim 15, further comprising:
an applicator head connectable to said housing sleeve for applying the vibratory energy thereof to the body of a patient.

17. An applicator handle according to claim 15 or 16, wherein said second bearing means comprises:
at least one inner race;
at least one outer race; and
ball bearing means between said inner and outer races, said housing sleeve being connected to said outer race.

18. An applicator handle comprising:
an elongate handle sleeve;
a drive shaft;
first bearing means operatively positioned between said handle sleeve and said drive shaft for supporting said drive shaft coaxially within said handle sleeve for rotation relative thereto;
a cylindrical support member having an offset axial hole extending therethrough, said drive shaft extending through said hole in said support member and being connected thereto;
an elongate housing sleeve surrounding said support member;
second bearing means operatively connected between said cylindrical support member and said housing sleeve, said cylindrical support member supporting said second bearing means and said housing sleeve with the axes thereof coaxial and offset from said drive shaft axis;
flexible means connected between said handle sleeve and said housing sleeve for preventing rotation of said housing sleeve relative to said handle sleeve whereby said housing sleeve translates laterally in a circular pattern upon rotation of said drive shaft; and
a second cylindrical support member having an offset axial hole extending therethrough, said drive shaft extending through said hole in said second support member and being connected thereto, said second bearing means being operatively connected between said first-mentioned and said second support members and said housing sleeve.

19. A handle according to claim 18, wherein said second bearing means comprises:
first and second inner bearing races;
first and second outer bearing races; and
ball bearing means between said first inner and outer races and said second inner and outer races, said housing sleeve being connected to said first and second outer bearing races.

20. A handle according to claim 19, wherein said first and second support members are positioned within said first and second inner bearing races, respectively, and are connected thereto.

21. An applicator handle according to claim 20, further comprising:

an applicator head connectable to said housing sleeve for applying the vibratory energy thereof to the body of a patient.

22. An applicator handle according to claim 21, further comprising:

a counterweight operatively connected to said drive shaft with the axis of said counterweight offset on an opposite side of said drive shaft axis from the axis of said second bearing means for balancing the weight of said housing sleeve, said second bearing means, and said applicator head.

23. An applicator handle according to claim 22, wherein said counterweight is made integral with said first and second support members and is connectable to said drive shaft together therewith.

* * * * *